United States Patent [19]

Rundquist

[11] Patent Number: 4,977,845

[45] Date of Patent: Dec. 18, 1990

[54] BOAT PROPULSION AND HANDLING SYSTEM

[75] Inventor: Carl E. Rundquist, St. Louis, Mo.

[73] Assignees: F. William Rundquist, St. Louis, Mo.; Robert A. Rundquist, Northampton, Mass.

[21] Appl. No.: 393,280

[22] Filed: Aug. 14, 1989

[51] Int. Cl.[5] ..... B63B 1/18; B63H 5/16

[52] U.S. Cl. ..... 114/289; 114/284; 114/285; 114/288; 114/291; 114/152; 440/69

[58] Field of Search ..... 114/284, 285, 291, 288, 114/289, 126, 152; 440/66, 68, 69, 73

[56] References Cited

U.S. PATENT DOCUMENTS

| | | | |
|---|---|---|---|
| 1,195,035 | 8/1916 | Langstoff | 440/68 |
| 1,344,518 | 6/1920 | Rees | 440/43 |
| 2,139,831 | 12/1938 | Langstaff | 440/68 |
| 2,996,031 | 8/1961 | Easter | 440/43 |
| 3,520,265 | 7/1970 | Sanford | 114/285 |
| 3,823,684 | 7/1974 | Baggs | 440/43 |
| 4,015,556 | 4/1977 | Bordiga | 440/69 |
| 4,027,613 | 6/1977 | Wollard | 114/291 |
| 4,088,091 | 5/1978 | Smith | 440/69 |
| 4,661,075 | 4/1987 | Czerniak | 440/69 |
| 4,895,093 | 1/1990 | Dalsbö | 440/43 |

FOREIGN PATENT DOCUMENTS

| | | | |
|---|---|---|---|
| 2096964 | 10/1982 | United Kingdom | 440/69 |

*Primary Examiner*—David H. Brown
*Attorney, Agent, or Firm*—Polster, Polster and Lucchesi

[57] ABSTRACT

An improved boat construction is disclosed in which a boat, having the typical elongated hull, bow and stern, has a bottom configured as a hydroplane including a transverse step spaced from the bow and stern. A well is provided in the boat bottom and extends from at least the transverse step through the boat stern and receives a powered impeller for engaging and pushing water backwards in a confined flow path within and beyond the well so as to thrust the boat forward. Vertical deflectors are positioned rearwardly of the powered impeller and are attached to the boat in the vicinity of the boat stern for engaging the backwardly moving water in the confined flow path so as to increase or decrease the size of the confined flow path of backwardly moving water emanating from the powered impeller. Immediately forward of the powered impeller in the well is a horizontal deflector which directs more or less water to the powered impeller. Trim plates are positioned immediately forward of the transverse step in the boat bottom for independent and joint operation. The above components provide improved boat speed and controlled boat performance, including operation in shallow water, as well as greater overall control of trim and bank movements.

25 Claims, 4 Drawing Sheets

BOAT PROPULSION AND HANDLING SYSTEM

BACKGROUND OF THE INVENTION

The present invention relates to an improved boat construction, and more particularly, to a power boat with an inboard propulsion and boat handling system providing improved boat speed and controlled boat performance.

Power boats have either outboard or inboard propulsions systems. Outboard propulsions systems include a combined outboard motor and propeller, pivotally mounted to the stern of a boat, in which the propeller pushes the water backward from behind the boat so as to thrust the boat forward. Steering of the boat is accomplished by turning the combined outboard motor and propeller on its pivotal mount in a particular direction to direct the bow of the boat in that same direction. Inboard propulsion systems include one or more powered inboard mounted propellers or impellers which drive a boat, as well as a separate or interconnected steering device or rudder which is mounted outboard of the boat to control the direction of the boat, as desired.

The efficiency of propulsion, that is, the proportion of the motor power output that is utilized for propelling the ship through the water, is determined by the difference between the approaching velocity of the water ahead of the propeller, which velocity is equal to the speed of the boat, and the velocity of the water displaced astern of the propeller at each revolution. When a boat starts up its motor and begins to move, small quantities of water are given a large sternward acceleration by the propeller; when the boat is underway, large quantities of water are given a relatively small acceleration.

If a boat could operate in a solid unyielding medium, each revolution of the propeller would cause the boat to travel a distance equal to the pitch of the propeller. In actuality, water is a yielding substance which gives way under the pressure or impact of the propeller. As a result, the actual forward motion achieved at each revolution is only about 60%-70% of the pitch. This difference, in relation to 100%, is known as the slip of the propeller. On the rear or suction side of the propeller, a negative pressure is produced, which is greater as the angle of incidence of the propeller blades is larger and their speed of rotation is higher. If the negative pressure is too great, the flow of water around the propeller blades is disrupted and bubbles filled with water vapor are formed. This phenomenon is known as cavitation. For this reason, high-speed propellers have very wide flat blades with low angles of incidence, to minimize losses in propulsion efficiency.

Another factor which inhibits or retards boat speed is the drag created by externally mounted rudders for steering or guiding the boat. As can be appreciated, externally mounted rudders provide a large surface which is pulled through the water and act to reduce the efficiency of propulsion by the rudder operating as an outside intervening force.

Other aspects of boat operation, all of which are related, at least in part to boat propulsion and drag, are also important. These other aspects include steering and handling of the boat in deep and shallow water, operation of the boat when the trim or longitudinal position of a boat is changed relative to the waterline, and control of the boat during banking movements.

As will be disclosed in the detailed description that follows, the present invention relates to an inboard propulsion and handling system in which the efficiency of the propulsion system is not only increased, but the overall performance and control of a boat containing the inboard propulsion system is enhanced. This includes better operation of the boat in shallow water, as well as greater overall control during trim and bank movements.

SUMMARY OF THE INVENTION

Among the several objects and advantages of the present invention include an improved boat construction with an inboard propulsion and boat handling system that provides improved boat speed and control boat performance over and above what has been achievable in prior art boat constructions;

The provision of the inboard propulsion and handling system which provides improved boat performance by means of a shape and construction which influences the flow of water through and beyond powered boat impellers;

The provision of the aforementioned boat propulsion and handling system which reduces the drag on the boat so as to increase boat speed;

The provision of the aforementioned boat propulsion and handling system which provides much greater steering and handling control to facilitate operation in shallow water;

The provision of the aforementioned boat propulsion and handling system in which a greater range of boat trim and banking movements are provided;

The provision of the aforementioned boat propulsion and handling system which controls backward moving water from powered impellers in a confined flow path that may be decreased to reduce back pressure on the impellers or widened to increase the jet effect of the backward moving water in the confined flow path;

The provision of the aforementioned boat propulsion and handling system in which the propulsion system can be made either as an integral part of the boat at the time the boat is initially manufactured, or installed as a stand-alone, self-contained housing for assembly in either new or used boats; and The provision of the aforementioned boat propulsion and handling system which is of unique and simple construction that is easy to manufacture, install and operate; which provides high propulsion efficiency; provides greater steering and handling control regardless of water depth or the trim or banking position of a boat during movement.

Briefly stated, the improved boat construction of the present invention is provided in a boat having an elongated hull with a bow and stern and having a bottom configured as a hydroplane including a transverse step spaced from the bow and stern. A well is provided in the boat bottom and extends at least the transverse step through the boat stern. Powered impeller means are contained within the well for engaging and pushing water backwards in a confined flow path within and beyond the well so as to thrust the boat forward. Vertical deflector means are positioned rearwardly of the powered impeller means and are operably attached to the boat in the vicinity of the boat stern for engaging the backwardly water in the confined flow path so as to increase or decrease the size of the confined flow path of backwardly moving water emanating from the powered impeller means. Horizontal deflector means are also positioned in the well immediately forward of the powered impeller means to direct more or less water to the powered impeller means. The boat construction as described provides improved speed and controlled performance which is explained further below.

The above described components may be incorporated into the boat during initial construction, or may be assembled by means of a stand-alone, self-contained housing including a well, powered impeller means, vertical deflector means and horizontal deflector means which are mounted within a complementary channel of a boat to provide the entire construction.

In addition to the above, spaced trim plates are positioned immediately forward of the transverse step in the boat bottom and extend near but are located inboard of the juncture between the boat bottom and boat sides. Preferably, an inboard waterway chine is provided on opposite sides of the elongated hull to form a watercourse on each side of the boat bottom, with each of the spaced trim plates being positioned adjacent to the chine on opposite sides of the boat bottom. The trim plates are independently and jointly operable for fore and aft trim control, as well as for both banking steering control and to counteract impeller torque.

The powered impeller means include at least two longitudinally spaced impeller means, each of simple true pitch propeller design, with the impeller nearest the boat stern having a relatively higher pitch to create a high velocity jet effect. The powered impeller means are preferably spaced upwardly from the boat bottom and are totally contained within the well, and with the boat bottom being constructed for access to the powered impeller means from within the boat.

The well includes side walls that taper away from each other to the boat stern, the powered impeller means being positioned in the well immediately forward of the tapering sides wall, and the vertical deflector means being operated within the tapering side wall area of the well. The vertical deflector means comprise a pair of vertical deflector plates mounted within the tapering side wall area of the well, the vertical deflector plates also being independently operable to increase or decrease the size of the confined flow path of backwardly moving water emanating from the powered impeller means, and the vertical deflector plates also being jointly operable for simultaneous joint movement to provide boat steering.

The horizontal deflector means includes a horizontal deflector plate pivotally mounted within the well at one end of the horizontal deflector plate remote from the powered impeller means, the horizontal deflector plate being moved relative to the well to provide more or less of the well opening and corresponding more or less water to the powered impeller means immediately rearwardly of the horizontal deflector plate.

These and other objects and advantages of the present invention will become more apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENT

Figure 1:
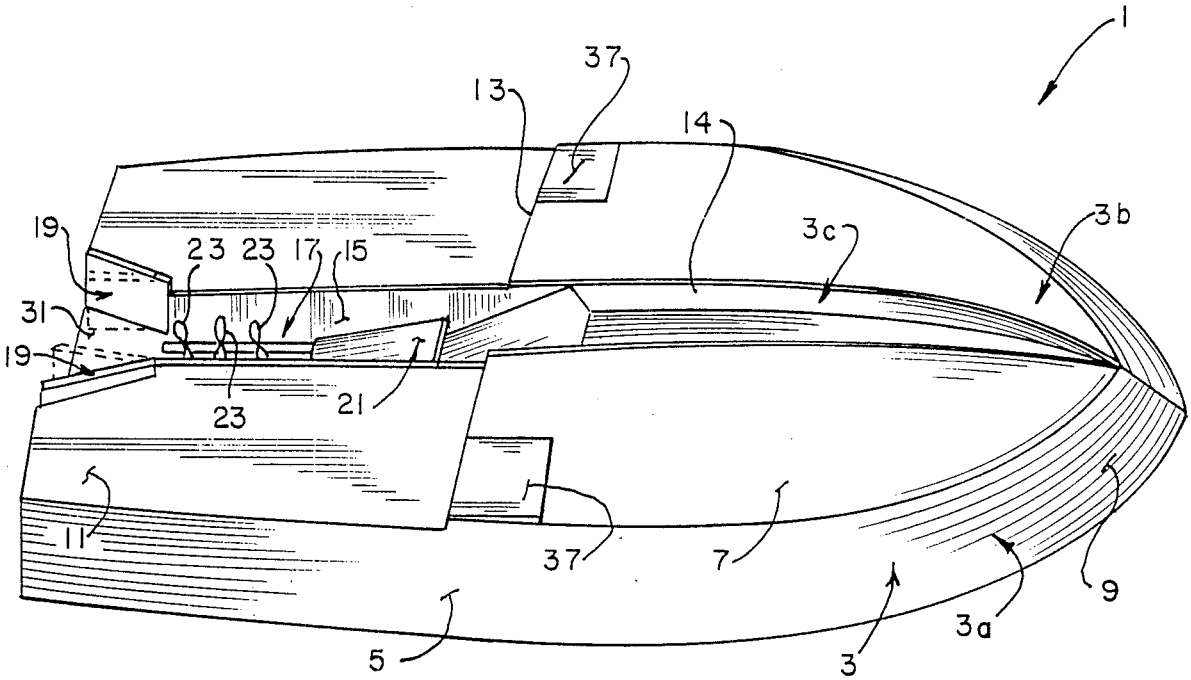
FIG. 1 is a perspective view of the improved boat construction which incorporates features of the present invention.

The following detailed description illustrates the invention by way of example, and not by way of limitation. This description will clearly enable one skilled in the art to make and use the invention, and describe several embodiments, adaptions, variations, alternatives and uses of the invention, including what I presently believe is the best mode of carrying out the invention.

In the discussion that follows, the improved boat propulsion and handling system that is disclosed is shown as being incorporated in an 18 foot pleasure boat, although it is to be understood that various types of pleasure, recreational and sport boats may be constructed to include the improved boat propulsion and handling system of the present invention. Some of the various types of boats include any type of pleasure, recreational or sport boat, yacht or water craft now adapted to use or capable of using an inboard propulsion system, as well as various types of commercial vessels such as tow boats and the like.

It will be further understood that the distances and dimensions disclosed herein are illustrative, and are not necessarily required dimensioning in an 18 foot pleasure craft. The boat propulsion and handling system of the present invention may, therefore, be adapted to meet the needs and demands of a particular hull shape and length, as may be desired.

As best seen in FIGS. 1–5 of the drawings, the boat 1 includes an elongated hull 3 having sides 5 and a bottom 7. The elongated boat hull 3 further include the typical bow and stern 9, 11, respectively, as is well known.

Figure 2:
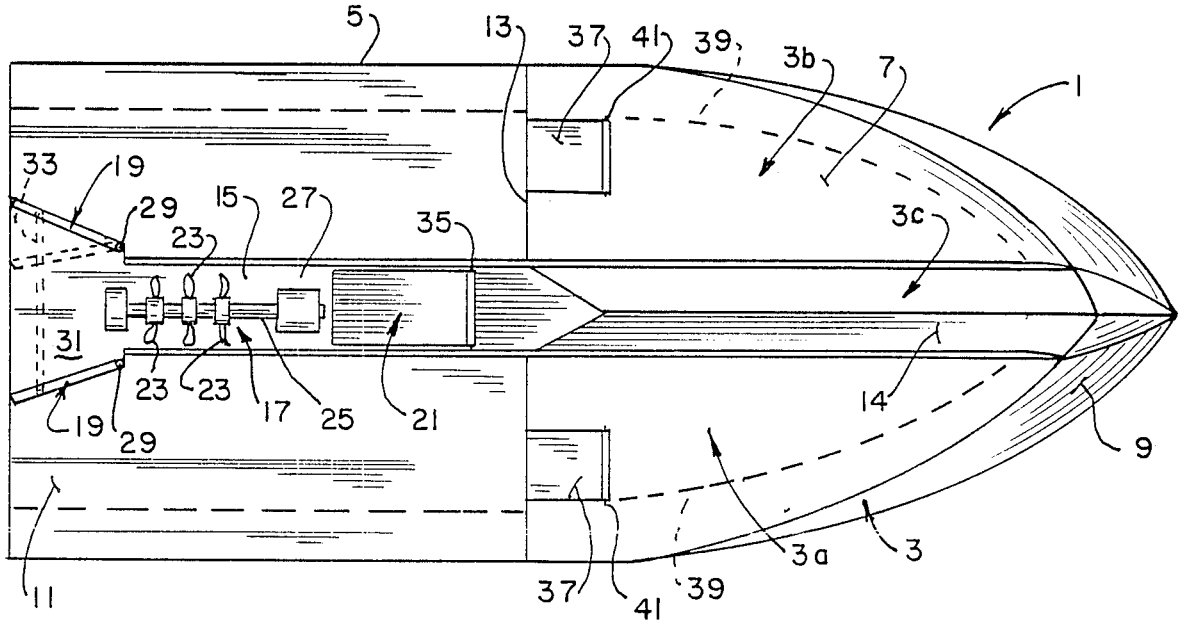
FIG. 2 is a bottom plan view of a slightly modified form of improved boat construction.

For use in power boat and other similar applications, the boat bottom 7 is configured as a hydroplane including a rather shallow step 13, which is positioned generally in a central area of the boat 1, as illustrated in FIGS. 1–2 of the drawings.

In the boat construction shown in FIGS. 1–5 of the drawings, the elongated hull 3 is formed from two identically constructed boat hull sections 3*a*, 3*b*, which are in mirror image relationship to one another, and an intermediate boat hull section 3*c* which is shaped and constructed to provide the boat propulsion and handling system of the present invention. As can be seen in FIG. 2 of the drawings, the mirror image boat hull sections 3*a* and 3*b* comprise a substantial part of the boat hull 3, with the intermediate section 3*c* constituting the remaining part of the boat hull 3. This construction represents one way in which the boat propulsion and handling system of the present invention can be incorporated into a boat, although there are other ways of achieving this, such as shown in the stand-alone self-contained housing shown in FIG. 6–9 of the drawings, to be subsequently described.

The intermediate boat hull section 3*c* is positioned between and is interconnected to the two outer boat hull sections 3*a* and 3*b*, as shown in FIG. 1–2 of the drawings. The intermediate hull section 3*c* is shown in FIGS. 1–2 of the drawings as including a boat-keel 14 in the front portion of the hull extending between the transverse step 13 and the bow 9. Rearwardly of the keel 14 and beginning in the vicinity of the transverse step 13, the intermediate boat hull section 3*c* is provided with a configured well 15 which extends at least from or near the vicinity of the transverse step 13, although in some boat constructions, the well 15 may extend from bow to stern, if required. In a boat having a length of 18 feet, the well 15 may be about 12 inches wide and about half the length of the overall boat length.

Within the configured well 15 is a powered impeller 17 located intermediate vertical deflector plates 19, 19 attached to and within the boat hull in the vicinity of the boat stern 11, and a horizontal deflector plate 21 positioned in the well 15 immediately forward of the powered impeller 17.

Figure 11:
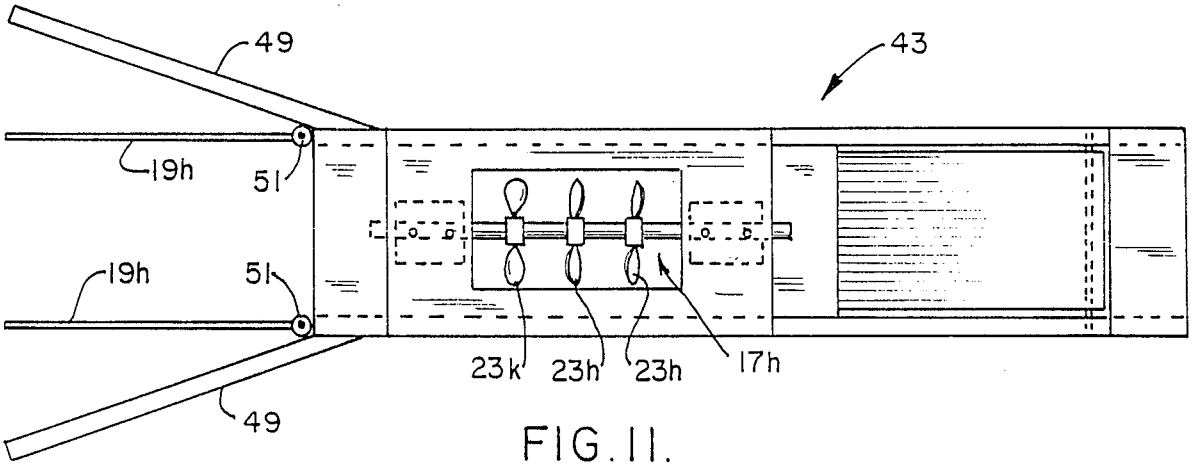
FIG. 11 is a bottom plan view of the stand-alone self-contained housing in which the impeller nearest the boat stern is provided with a relatively higher pitch than the other impellers.

The powered impeller 17 ise shown in the drawings as comprising three relatively small in diameter simple true pitch propellers 23, 23, 23, preferably having a relatively higher pitch toward the stern 11 so as to create a higher velocity or jet effect. This is best seen in FIG. 11 of the drawings where the impeller 23*k* nearest the boat stern has a relatively higher pitch, in the stand-alone, self-contained housing 43 embodiment to be described in detail hereafter. Each of the impellers 23 are mounted on the shaft 25 which can either be driven directly by a motor (not shown) or by bevel gears (not shown) from a vertical drive shaft (not shown), all of which are well known constructions. The impellers 23 are located within the configured well 15 so that they are approximately 2–4 feet from the boat stern 11 in the 18 foot boat illustration, and are also fully contained within the configured well 15. The bottom wall 27 of the configured well 15, at least in the vicinity of the powered impellers 17, is also constructed so as to be removable from within the boat, thereby providing access to the powered impeller 17 for maintenance and repair, as needed.

The vertical deflector plates 19, 19 are positioned rearwardly of the powered impeller 17 and are pivotally attached as at 29 to the boat hull 3 so as to be operably attached to and within the boundaries or confines of the boat hull 3, in the vicinity of the boat stern 11. The vertical deflector plates 19, 19 are pivotally mounted within the tapering side wall well extension area 31 of the well 15 nearest the boat stern 11. Each of the vertical deflector plates 19, 19 are independently operable so as to increase or decrease the size of outwardly moving water emanating from the powered impeller 17 in a confined flow path within the well 15, so as to increase or decrease the size of the confined flow path of backwardly moving water. When the deflector plates 19 are moved apart from one another, such as represented by the fully opened deflector plates 19, 19 shown in FIGS. 1–2 of the drawings, the vertical deflector plates 19, 19 will widen out the confined flow path of backwardly moving water emanating from the powered impellers 17 so as to relieve the back pressure on the impellers 23. When the one or both of the vertical deflector plates 19, 19 are moved toward one another, as represented by the dotted line position shown in FIGS. 1–2 of the drawings, there will be a restriction or choking-in of the confined flow path of backwardly moving water emanating from the powered impeller 17 which will intensify the velocity or jet effect. An interconnecting bar 33 or other suitable means such as a common drive may be employed for jointly and simultaneously operating the deflector plates 19, 19 in simultaneous movement to either the right or left of the boat during movement, in order to provide boat steering, thus eliminating the need for a rudder which would normally extend behind the boat stern 11 creating unnecessary drag on boat speed.

Figure 12:
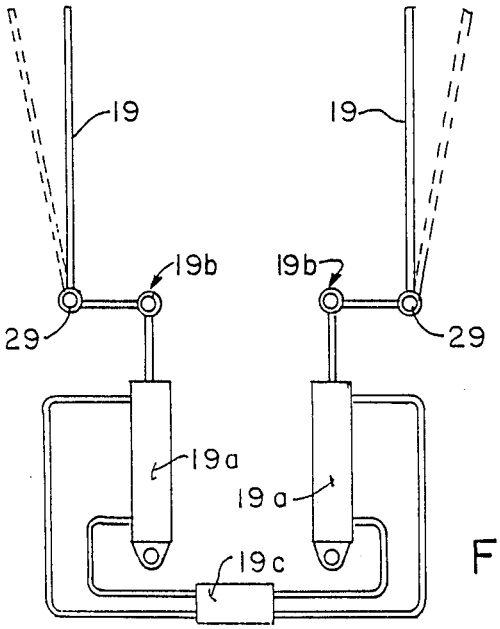
FIG. 12 is a diagrammatic illustration of hydraulic cylinders to permit joint or independent operation of the vertical deflector plates.

One form of common drive is shown in FIG. 12 of the drawings where each of the vertical deflector plates 19, 19 are shown as being operated by a hydraulic cylinder 19*a* and linkage 19*b* for movement, as desired. To provide joint or independent movement, control means 19*c* may be operated for this purpose, as is well known in the art.

A horizontal deflector plate 21 is positioned in the well 15 immediately forward of the powered impeller 17 and is pivotally mounted to the boat hull section 3*c* as at 35. The horizontal deflector, in effect, opens and closes the well 15 immediately forward of the powered impeller 17 so as to direct more or less water to the powered impeller 17, depending on the speed and other requirements.

Figure 3:
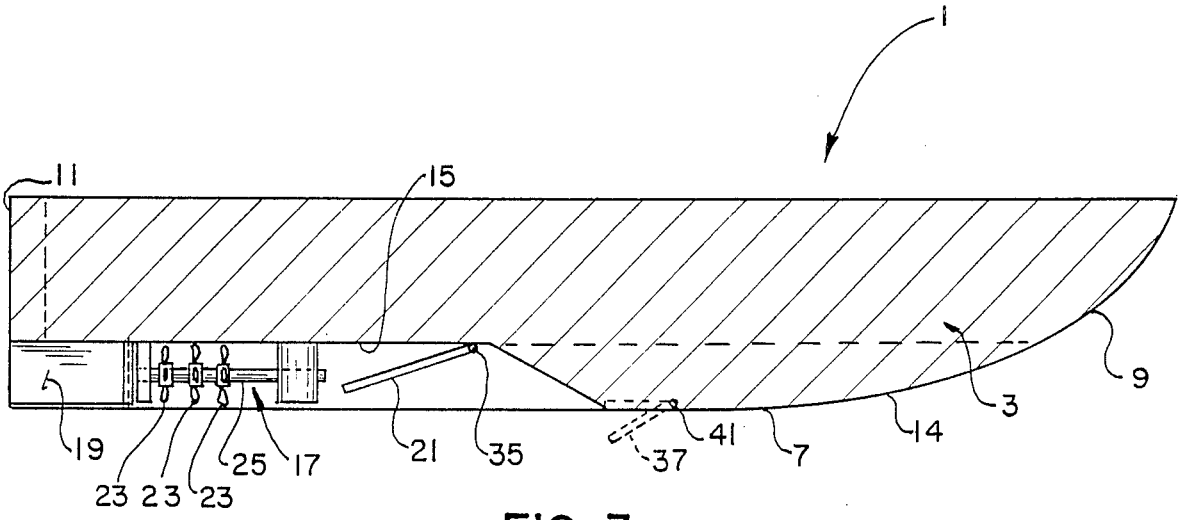
FIG. 3 is a sectional view along the center line of the boat shown in FIGS. 1 and 2, and further illustrating the features of the improved boat construction.
Figure 4:
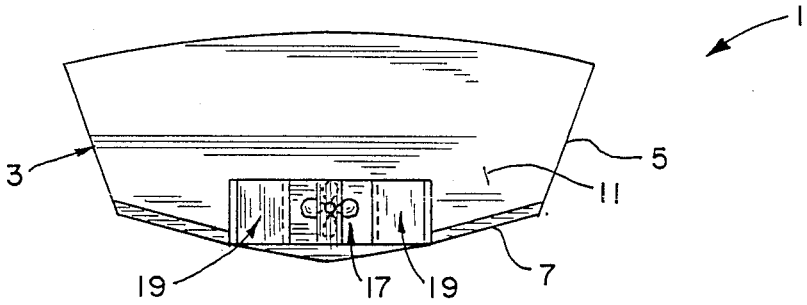
FIG. 4 is a rear elevational view of the improved boat construction.
Figure 5:
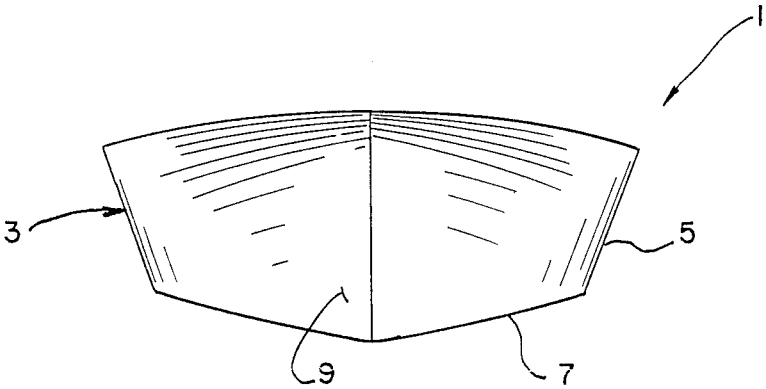
FIG. 5 is a front elevational view of the improved boat construction.

FIGS. 1–2 and 4 of the drawings best illustrate the manner in which the vertical deflectors plates 19, 19 operate independently or in conjunction with one another, whereas FIG. 3 of the drawings best illustrates the manner in which the horizontal deflector 21 opens and closes the well opening immediately ahead to the powered impeller 17, thereby providing more or less water to the powered impeller 17.

As a further important feature of the present invention, at least one pair of horizontal trim plates 37, 37 are positioned immediately forward of the transverse step 37 in the boat bottom 7 and extend near to but are located inboard of the junction between the boat bottom 7 and boat sides 5. As shown in FIG. 1 of the drawings, the illustrated boat construction shows the spaced trim plates 37, 37 as being positioned immediately forward of the transverse step 13 in the boat bottom 7 while also being adjacent to the juncture between the boat bottom 7 and boat sides 5. In FIG. 2 of the drawings, a modified form of boat bottom 7 shows, in dotted lines, inboard waterway chines 39, 39 on opposites sides of the elongated hull 3 which form a watercourse on each side of the boat bottom 7, to stabilize the boat. With such a bottom boat construction, the horizontal trim plates 37, 37 are shown as being positioned adjacent to the chines 39, 39 on opposite sides of the boat 1.

The horizontal trim plates are pivotally mounted to the boat bottom 7 as at 41, 41 (see FIGS. 2–3) and have a dimensional configuration, in an 18 foot boat length, of approximately 8 inches square. Each of the trim plates are both independently and jointly operable by control means (see FIG. 13) within the boat for directing the water flow up or down, as may be desired.

Figure 13:
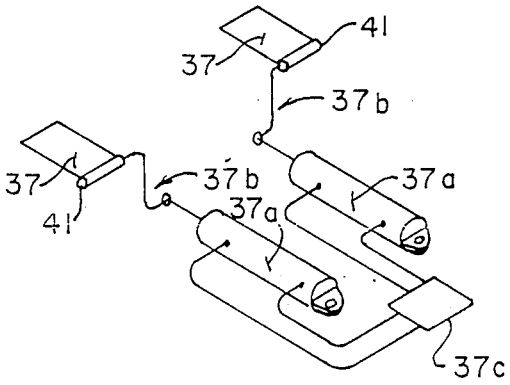
FIG. 13 is a diagrammatic illustration of another set of hydraulic cylinders to permit joint or independent operation of the vertical deflector plates.

As shown in FIG. 13, control means 37*c* can jointly or independently operate the hydraulic cylinders 37*a* and linkage 37*b* for raising or lowering the trim plates 37, 37, much in the same way that the vertical plates 19, 19 are jointly or independently activated, as shown in FIG. 12.

Specifically, each of the horizontal trim plates are normally even with the boat bottom 7, as shown in FIGS. 1–2 of the drawings, but can be independently or jointly operable in an extended position (see FIG. 3) for directing the water flow in an up or down direction. The purpose of the spaced trim plates 37, 37 is multifold. In the first place, they control fore and aft trim movement, that is, the longitudinal position of the boat 1 relative to the water line. As can be appreciated, if it is desired to change the fore and aft trim or longitudinal position of the boat 1 relative to the water line, the horizontal trim plates 37, 37 are operated to change the fore and aft longitudinal or trim positions of the boat 1, as desired. There are two other purposes of the spaced horizontal trim plates 37, 37. When the boat is banked during turning, banking is enhanced by operating one or both of the trim plates 37, 37, 37 which greatly facilitates steering of the boat. Another purpose of the spaced trim plates 37, 37 is to counteract impeller torque. It should be apparent that the powered impeller 17 imparts forces generally along the center line of the boat; however, in changing the direction and in banking movements, one or both of the trim plates 37, 37 may be usefully employed to counteract propeller torque, operating against the banking movement, to provide greater balance and stability to the boat.

Reference is now made to FIGS. 6–11 of the drawings for a disclosure of the stand-alone, self-contained housing 43 which may be used in new boat construction or can also adapt used boats with the boat propulsion and handling system of the present invention. Similar reference numerals with the suffix h will be used to designate corresponding or like parts in both embodiments.

Figure 10:
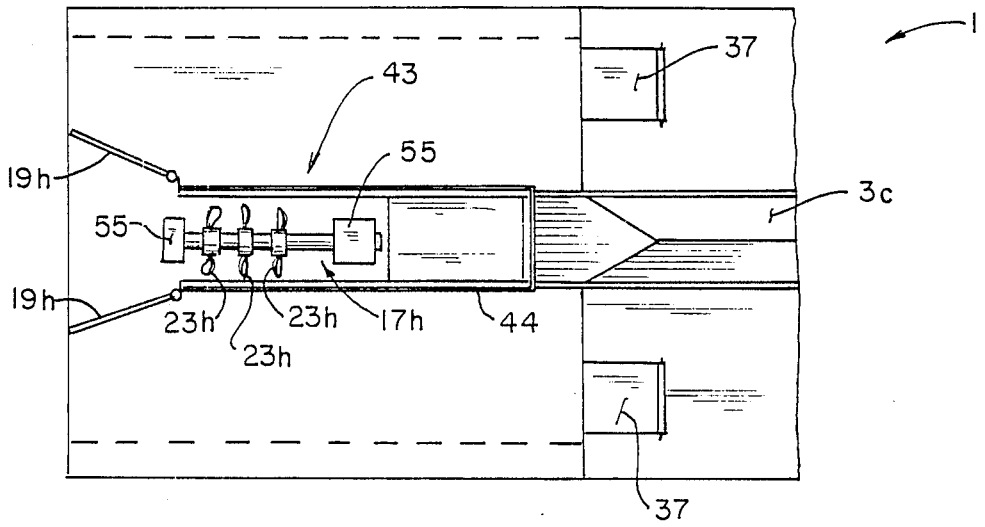
FIG. 10 is a fragmentary bottom plan view of a boat construction having a complementary channel into which the stand-alone, self-contained housing illustrated in FIGS. 6–9 is mounted.

The stand-alone, self-contained housing 43 is an elongated, rectangular shaped element that is mounted within a complementary channel 44 formed in the boat 1 as shown in FIG. 10 of the drawings, and corresponds in construction and operation to the same components described in connection with FIGS. 1–5 of the drawings. Specifically, the elongated housing 43 includes spaced and parallel side panels 45, 45 which are interconnected at opposite ends such as by the plates 47, 47 at the rear of the spaced and parallel side sections 45, 45. Tapering side sections 49, 49 are connected, to the rear of the spaced side sections 45, 45. The spaced side sections 45, 45 correspond to the well 15 provided in the boat bottom in the FIGS. 1–5 embodiment, while the tapering side sections 49, 49 correspond to the tapering side wall well extension 31 in the FIGS. 1–5 embodiment.

The vertical deflector plates 19*h*, 19*h* are pivotally mounted to the spaced side wall sections 45, 45 at 51, 51. The spaced vertical deflector plates 19*h*, 19*h* operate within the spaced tapered side wall sections 49, 49 and are independently as well as being simultaneously operable with respect to one another, for the same purposes as set forth in the FIGS. 1–5 embodiment. At an opposite end of the elongated housing 43, the horizontal deflector plate 21*h* is pivotally mounted at 53 to the spaced side wall sections 45, 45.

Figure 6:
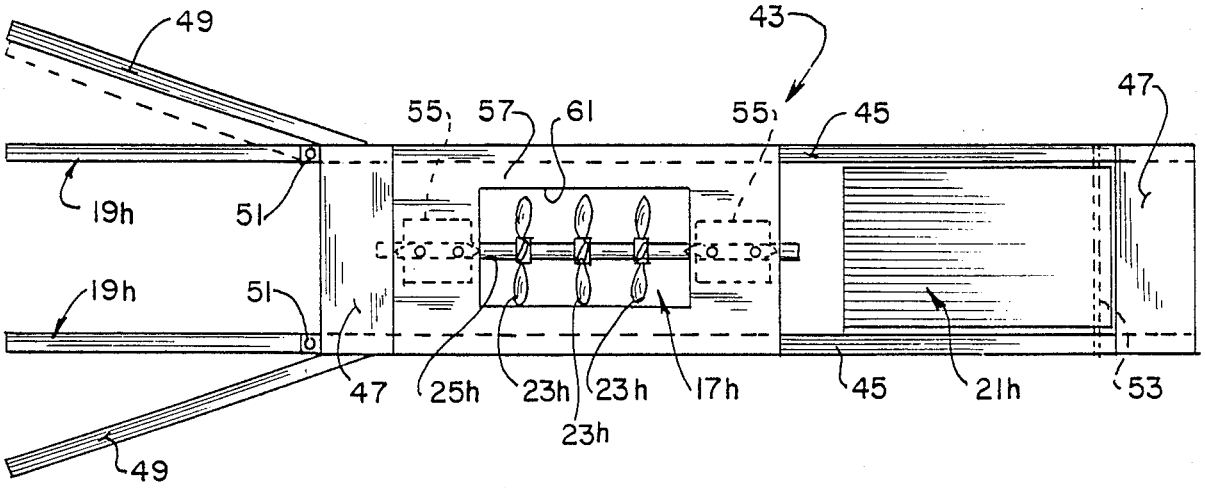
FIG. 6 is a top plan view of a stand-alone, self-contained housing capable of being assembled in new or used boats to provide the improved boat construction.
Figure 7:
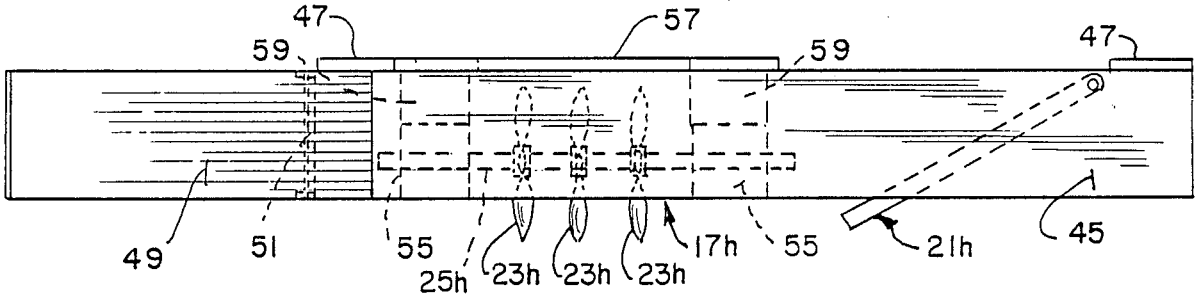
FIG. 7 is a side elevational view of the stand-alone, self-contained housing shown in FIG. 6.
Figure 8:
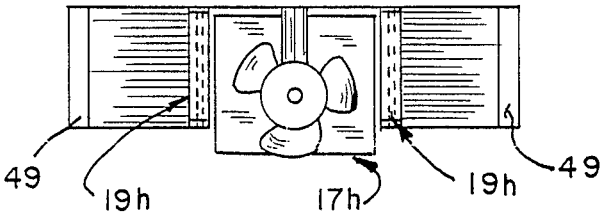
FIG. 8 is a rear elevational view of the stand-alone, self-contained housing.
Figure 9:
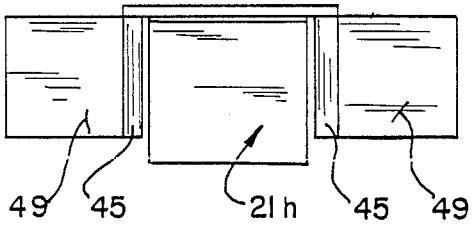
FIG. 9 is a front elevational view of the stand-alone, self-contained housing.

In between the vertical deflector plates 19*h*, 19*h* and the horizontal deflector plate 21*h* in the stand-alone, self-contained elongated housing 43 is the powered impeller 17H. Each of the impellers 23*h* are mounted on the shaft 25*h* which is journaled at opposite ends in the bearing journals 55, 55. Each of the bearing journals 55 are either supported between the spaced side sections 45, 45 or by an interconnecting plate 57 as shown in FIGS. 6–7 of the drawings. The interconnecting plate 57 rests atop the spaced side sections 45, 45 of the elongated housing in an area overlying the powered impeller 17*h*, as shown. Extensions 59, 59 depending from the interconnecting plate 57 provide structural support for the bearing journals 55, 55, as will be appreciated Although not shown in FIG. 6–9, a suitable direct drive motor (not shown) or bevel gear/motor arrangements (not shown) for driving the shaft 25*h* may be employed, as desired.

It will be noted that the interconnecting plate 57 includes an opening 61 for visibility of the powered impeller 17*h*. Opening 61 is closed by a suitable panel (not shown) within the boat for easy access to the powered impeller 17*h* for repair and maintenance thereof.

When mounted in a complementary-shaped channel formed in a boat bottom, the stand-alone, self-contained elongated housing 43, including components described above, will function in the same manner as the corresponding components in the FIGS. 1–5 embodiment, to provide an improved boat propulsion and handling system. In conjunction with the stand-alone, self-contained elongated housing 43, suitable trim plates may also be employed, if desired, for the same purposes as described above.

From the foregoing, it will be appreciated that the boat propulsion and handling system of the present invention provides an improved boat construction, with improved boat speed and controlled boat performance through configured shapes and constructions that influence the flow of water through and beyond powered boat impellers. The boat propulsion and handling system controls backward moving water emanating from powered impellers to move in a confined flow path that may be decreased to reduce back pressure on the impellers or widened to increase the jet effect of the backward moving water in the confined flow path. In addition, the boat propulsion and handling system of the present invention reduces drags to increase boat speed and handling, while providing greater steering and handling control to facilitate operation regardless of the depth of the water. Further advantages include greater range of boat trim and banking movements, including fore and aft trim control and banking or turning movements, while counteracting impeller torque. The boat propulsion and handling system can be incorporated either as an integral part of the boat at the time the boat is initially constructed or installed in either new or used boats through the use of a stand-alone, self-contained housing for mounting in a complementary channel provided in the boat.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

What is claimed is:

1. An improved boat construction, comprising:

a boat having an elongated hull with a bow and a stern and having a bottom configured as a hydroplane including a transverse step spaced from the bow and stern;

a well provided in the boat bottom and extending from at least the transverse step through the boat stern;

powered impeller means contained within the well for engaging and pushing water backwards in a confined flow path within and beyond the well so as to thrust the boat forward;

vertical deflector means positioned rearwardly of the powered impeller means and operably attached to and within the boat hull in the vicinity of the boat stern for engaging the backwardly moving water in the confined flow path so as to increase or decrease the size of the confined flow path of backwardly moving water emanating from the powered impeller means; and horizontal deflector means positioned in the well immediately forward of the powered impeller means to direct more or less water to the powered impeller means, whereby improved speed and controlled performance of the boat results.

2. The improved boat construction as defined in claim 1 wherein the vertical deflector means comprise vertical deflector plates pivotally mounted to and within the confines of said boat on opposite sides of said backwardly moving water confined flow path and also being jointly operable for simultaneous joint movement to provide boat steering.

3. The improved boat construction as defined in claim 1 wherein the horizontal deflector means includes a horizontal deflector plate that is pivotally mounted within the well at one end of said horizontal deflector plate remote from the powered impeller means, said horizontal deflector plate being moved relative to the well to provide more or less of the well opening and corresponding more or less water to the powered impeller means immediately rearwardly of the horizontal deflector plate.

4. The improved boat construction as defined in claim 1 comprising a stand alone, self-contained housing including said well, said powered impeller means, said vertical deflector means and said horizontal deflector means, said housing including said components being mounted within a complementary channel of a boat constructed as defined above.

5. The improved boat construction as defined in claim 4 wherein the vertical deflector means comprise vertical deflector plates pivotally mounted to said boat on opposite sides of said backwardly moving water confined flow path and also being jointly operable for simultaneous joint movement to provide boat steering.

6. The improved boat construction as defined in claim 4 wherein the powered impeller means include at least two longitudinally spaced impeller blades each of simple true pitch propeller design, the impeller nearest the boat stern having a relatively higher pitch to create a high velocity jet effect.

7. The improved boat construction as defined in claim 6 wherein the powered impeller means is totally contained within the well, said boat bottom having a removable bottom wall for access to the powered impeller means from within the boat.

8. The improved boat construction as defined in claim 7 wherein the well includes a well extension adjacent the boat stern including sidewalls that taper away from each other to the boat stern, said powered impeller means being positioned in the well immediately forward of the tapering sidewalls, and said vertical deflector means being operated within the tapering sidewall well extension area of said well.

9. The improved boat construction as defined in claim 8 wherein the vertical deflector means comprise a pair of vertical deflector plates mounted within the tapering sidewall well extension of said well, said vertical deflector plates being independently operable to increase or decrease the size of the confined flow path of backwardly moving water emanating from the powered impeller means, and said vertical deflector plates also being jointly operable for simultaneous joint movement to provide boat steering.

10. The improved boat construction as defined in claim 9 wherein the horizontal deflector means includes a horizontal deflector plate that is pivotally mounted within the well at one end of said horizontal deflector plate remote from the powered impeller means, said horizontal deflector plate being moved relative to the well to provide more or less of the well opening and corresponding more or less water to the powered impeller means immediately rearwardly of the horizontal deflector plate.

11. The improved boat construction as defined in claim 1 including spaced trim plates positioned immediately forward of the transverse step in the boat bottom and extending near but located inboard of the juncture between the boat bottom and boat sides, said trim plates being independently and jointly operable for fore and aft trim control as well for banking steering control and counteracting impeller torque.

12. The improved boat construction as defined in claim 11 and including an inboard waterway chine on opposite sides of the elongated hull to form a watercourse on each side of the boat bottom, each of said spaced trim plates being positioned adjacent to the chine on opposite sides of the boat bottom.

13. The improved boat construction as defined in claim 12 wherein the powered impeller means include at least two longitudinally spaced impeller blades each of simple true pitch propeller design, the impeller nearest the boat stern having a relatively higher pitch to create a high velocity jet effect.

14. The improved boat construction as defined in claim 13 wherein the powered impeller means is totally contained within the well, said boat bottom having a removable bottom wall for access to the powered impeller means from within the boat.

15. The improved boat construction as defined in claim 14 wherein the well includes sidewalls that taper away from each other to the boat stern, said powered impeller means being positioned in the well immediately forward of the tapering sidewalls, and said vertical deflector means being operated within the tapering sidewall well extension area of said well.

16. The improved boat construction as defined in claim 15 wherein the vertical deflector means comprise a pair of vertical deflector plates mounted within the tapering sidewall well extension area of said well, said vertical deflector plates being independently operable to increase or decrease the size of the confined flow path of backwardly moving water emanating from the powered impeller means, and said vertical deflector plates also being jointly operable for simultaneous joint movement to provide boat steering.

17. The improved boat construction as defined in claim 16 wherein the horizontal deflector means includes a horizontal deflector plate pivotally mounted within the well at one end of said horizontal deflector plate remote from the powered impeller means, said horizontal deflector plate being moved relative to the well to provide more or less of the well opening and corresponding more or less water to the powered impeller means immediately rearwardly of the horizontal deflector plate.

18. An improved boat construction, comprising:

a boat having an elongated hull with a bow and a stern and a bottom;

a well provided in the boat bottom and extending from the boat stern for a predetermined distance towards the boat bow;

powered impeller means contained within the well for engaging and pushing water backwards in a confined flow path within and beyond the well so as to thrust the boat forward;

vertical deflector means positioned rearwardly of the powered impeller means and operably attached to and within the the boat hull in the vicinity of the boat stern for engaging the backwardly moving water in the confined flow path so as to increase or decrease the size of the confined flow path of backwardly moving water emanating from the powered impeller means; and horizontal deflector means positioned in the well immediately forward of the powered impeller means to direct more of less water to the powered impeller means, whereby improved speed and controlled performance of the boat results.

19. The improved boat construction as defined in claim 18 including a stand alone, self-contained housing including a well, powered impeller means, vertical deflector means and horizontal deflector means, said housing and defined components being mounted within a complementary channel of a boat constructed as defined above.

20. The improved boat construction as defined in claim 18 including spaced trim plates positioned between the boat bow and boat stern in the boat bottom and extending near but located inboard of the juncture between the boat bottom and boat sides, said trim plates being independently and jointly operable for fore and aft trim control as well as for banking steering control and counteracting impeller torque.

21. The improved boat construction as defined in claim 18 wherein the powered impeller means include at least two longitudinally spaced impeller blades each of simple true pitch propeller design, the impeller nearest the boat stern having a relatively higher pitch to create a high velocity jet effect.

22. The improved boat construction as defined in claim 18 wherein the vertical deflector means comprise a pair of vertical deflector plates mounted within the tapering sidewall well extension of said well, said vertical deflector plates being independently operable to increase or decrease the size of the confined flow path of backwardly moving water emanating from the powered impeller means, and said vertical deflector plates also being jointly operable for simultaneous joint movement to provide boat steering.

23. The improved boat construction as defined in claim 18 wherein the vertical deflector means comprise vertical deflector plates pivotally mounted to and within the confines of of said boat on opposite sides of said backwardly moving water confined flow path and also being jointly operable for simultaneous joint movement to provide boat steering.

24. The improved boat construction as defined in claim 18 wherein the powered impeller means is totally contained within the well, said boat bottom having a removable bottom wall for access to the powered impeller means from within the boat.

25. The improved boat construction as defined in claim 24 wherein the well includes a well extension adjacent the boat stern including sidewalls that taper away from each other to the boat stern, said powered impeller means being positioned in the well immediately forward of the tapering sidewalls, and said vertical deflector means being operated within the tapering sidewall well extension area of said well.

* * * * *